US006564424B1

(12) United States Patent
Audisio

(10) Patent No.: US 6,564,424 B1
(45) Date of Patent: May 20, 2003

(54) DOOR-STOP DEVICE FOR VEHICLES

(75) Inventor: Vittorio Audisio, Milan (IT)

(73) Assignee: Gammastamp SPA, Turin (IT)

( * ) Notice: Subject to any disclaimer, the term of this patent is extended or adjusted under 35 U.S.C. 154(b) by 17 days.

(21) Appl. No.: 09/785,640

(22) Filed: Feb. 16, 2001

(51) Int. Cl.[7] ..... E05F 5/02

(52) U.S. Cl. ..... 16/86 B; 16/86 C; 16/332; 16/334; 292/275; 296/146.11

(58) Field of Search ..... 16/86 B, 86 C, 16/82, 332, 334; 292/275, 278, DIG. 57, DIG. 15; 296/146.11, 146.12

(56) References Cited

U.S. PATENT DOCUMENTS 2,693,616 A * 11/1954 Cromwell et al.
2,787,019 A * 4/1957 Galla
3,820,192 A * 6/1974 Nakano et al.
3,837,040 A * 9/1974 Keller et al.
3,905,064 A * 9/1975 Breockhaus
4,380,848 A * 4/1983 Guionie et al.
4,997,221 A * 3/1991 Tolle et al. ..... 292/275
5,112,091 A * 5/1992 Kluting ..... 292/262
5,291,634 A * 3/1994 Zanetti ..... 16/333
6,148,481 A * 11/2000 Chen ..... 16/334

FOREIGN PATENT DOCUMENTS

DE 4207650 A1 9/1993
EP 3915865 C1 1/1991
FR 2 622 624 5/1989

* cited by examiner

*Primary Examiner*—Anthony Knight
*Assistant Examiner*—Alison K. Pickard
(74) *Attorney, Agent, or Firm*—Traskbritt

(57) ABSTRACT

A door-stop device for vehicles having a base structure with a pair of rollers that are parallel to each other and pushed against one another. The door-stop device also includes a metal tie rod with a pair of rolling surfaces set opposite to one another where the rollers act. The rolling surfaces have a positioning notch designed to engage one of the rollers and define a position of stable retention of the door. The positioning notch includes an arched central portion with an extension extending in the direction of the longitudinal axis of the tie rod and a pair of arched lateral portions with a radius of curvature.

5 Claims, 1 Drawing Sheet

DOOR-STOP DEVICE FOR VEHICLES

BACKGROUND OF THE INVENTION

1. Field of the Invention

The present invention relates to a door-stop device for vehicles, of the type comprising: a base structure carrying a pair of rollers that turn about respective axes which are parallel to one another and are elastically pushed against one another; and a metal tie rod having a pair of rolling surfaces set opposite to one another, on which the above-mentioned rollers act, said rolling surfaces presenting at least one positioning notch designed to be engaged by one of said rollers to define a position of stable retention of the door.

2. State of the Art

One of the problems of the door-stop devices of the type indicated above lies in the fact that these devices, during the movement of opening and closing of the door, present an intrinsic noisiness due to the rolling of the rollers on the corresponding rolling surfaces of the tie rod. Automobile manufacturers set very strict limits on the maximum noise level admitted for such devices. For example, door-stop devices that produce noise levels higher than 52 dB are frequently not considered acceptable.

Although numerous solutions have been adopted to reduce the noise levels of the door-stop devices in question, as yet a definitive solution to the problem has not been found.

BRIEF SUMMARY OF THE INVENTION

The aim of the present invention is to provide an improved door-stop device that enables a reduction in the noise levels as compared to known devices, at the same time without this involving an increase in the production cost.

According to the present invention, the above purpose is achieved by a door-stop device having the characteristics that form the subject of the main claim.

A door-stop device for vehicles comprises: a base structure (12) carrying a pair of rollers (1, 2) that turn about respective axes which are parallel to one another and are elastically pushed against one another; and a metal tie rod (14) having a pair of rolling surfaces (26, 28) set opposite to one another, on which the above-mentioned rollers (1, 2) act, said rolling surfaces (26, 28) presenting at least one positioning notch (32) designed to be engaged by one of said rollers (1, 2) to define a position of stable retention of the door.

The aforesaid positioning notch (32) presents: an arched central portion having a radius of curvature $R_a$=(10 to 15) $R_1$, where $R_1$ is the radius of the corresponding roller (1); a pair of arched lateral portions with a radius of curvature $R_{b=(}$1.1 to 1.8) $R_1$, where the aforesaid central portion has an extension, in the direction of the longitudinal axis of the tie rod, A=(0.15 to 0.30) $R_1$ (FIG. 2).

BRIEF DESCRIPTION OF THE SEVERAL VIEWS OF THE DRAWINGS

The present invention will now be described in detail with reference to the attached drawings, which are provided purely to furnish a non-limiting example, and in which.

DETAILED DESCRIPTION OF THE INVENTION

Figure 1:
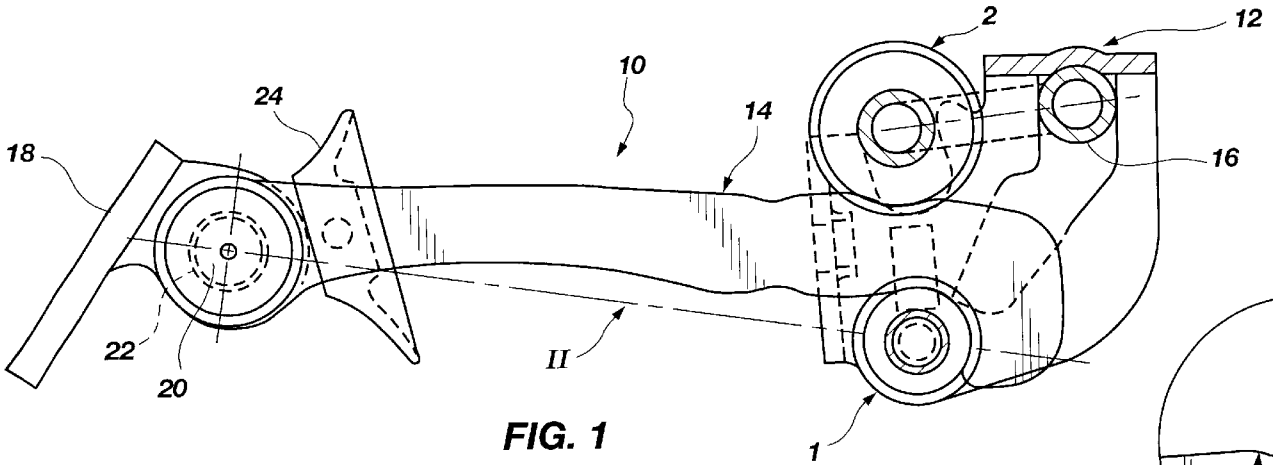
FIG. 1 is a partially sectional plan view of a door-stop device according to the present invention.

With reference to FIG. 1, the number 10 designates a door-stop device for vehicles comprising, in a known way, a base structure 12 designed to be fixed to an oscillating door of a vehicle (not illustrated), and a metal tie rod 14 designed to be connected in an articulated way to an upright of the motor vehicle (not illustrated either). The base structure 12 carries a first roller 1, which is mounted so that it can turn with respect to the base structure 12 about a fixed axis orthogonal to the plane of representation of FIG. 1. The base structure 12 moreover carries a torsion bar consisting of a metal bar 16 anchored to the base structure 12 and carrying at one of its ends a second roller 2 which is free to turn about an axis parallel to the axis of the first roller 1 and is elastically pushed towards the first roller 1 by the elastic loading of the spring 16.

The metal tie rod 14 carries at one of its ends an articulation element 18 which is designed to be fixed to the upright of a vehicle (not illustrated). The tie rod 14 is articulated to the articulation element 18 by means of a pin 20 that engages a through hole 22 formed at one end of the tie rod 14. The tie rod 14 may be provided with a protection element 24 made of plastic material co-molded at one end of the tie rod 14, as described in the Italian Patent Application No. TO98A000304 of the present applicant.

Figure 2:
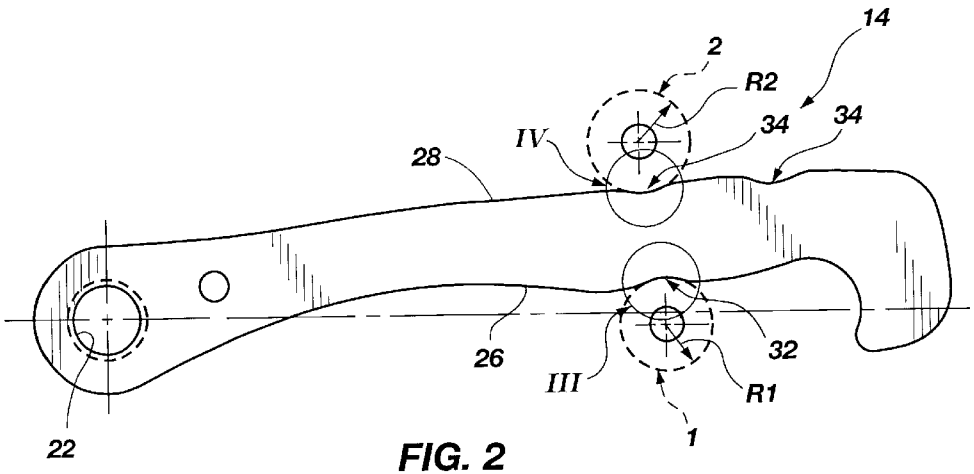
FIG. 2 is a plan view at a larger scale of the part indicated by the arrow II in FIG. 1.

With reference to FIG. 2, the metal tie rod 14 presents two rolling surfaces 26, 28 set opposite to one another on which the two rollers 1, 2 roll during the opening and closing movements of the door. The rolling surface 26 ends with a hook-shaped seat 30 which cooperates with the fixed-axis roller 1 to withhold the door of the vehicle in a position of maximum opening. Along the rolling surface 26 is made at least one positioning notch 32 defining a partially open position of the door. Positioning notches 34 are preferably provided also on the rolling surface 28 in positions corresponding to the hook-shaped seat 30 and to the or each positioning notch 32.

Figure 3:
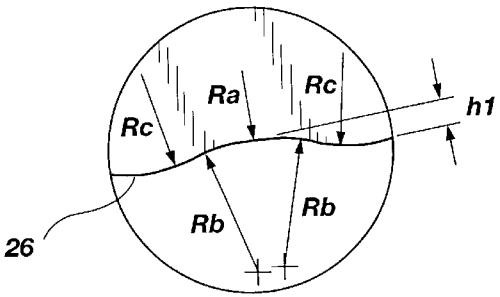

The present invention has stemmed from the realization that a considerable part of the noise produced by the door-stop device 10 during opening and closing of the door is due to the impact of the rollers 1, 2 against the walls of the positioning notches 32 and, where present, 34. According to the present invention, by appropriately shaping the positioning notches, a considerable reduction is obtained in the noise level of the device. In particular, with reference to FIG. 3, the positioning notch 32 is made in such a way as to present an arched central portion having a radius of curvature Ra and two arched lateral portions having a radius of curvature Rb. The arched lateral portions are radiused to the remaining part of the rolling surface 26 by means of appropriately sized connecting radiuses $R_c$. The central portion with radius of curvature $R_a$ has an axial extension designated by A in FIG. 3, whilst the depth of the positioning notch 32 is designated by $h_1$.

According to the present invention, designating by $R_1$ the radius of the roller 1, the dimensions $R_a$, $R_b$, A and $h_1$ that enable optimization of the reduction in noise level of the device are as follows:

$R_a$=(10 to 15)$R_1$ $R_b$=(1.1 to 1.8)$R_1$ $R_c$=(0.15 to 0.30)$R_1$ $h_1$=(0.12 to 0.50)$R_1$

Figure 4:
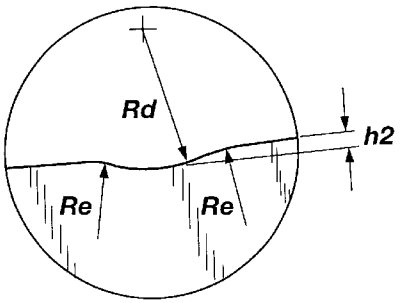
FIGS. 3 and 4 are details at a larger scale of the parts designated by the arrows III and IV in FIG. 2.

With reference to FIG. 4, the positioning notches 34, where present, preferably have an arched shape with a radius of curvature $R_d$ and a depth $h_2$, and are radiused to the remaining part of the rolling surface 28 by means of appropriately sized connecting radiuses $R_e$. The dimensional values of $R_d$ and $h_2$ are preferably as follows:

$R_d$=(1.1 to 1.6)$R_2$ $h_2$=(0.12 to 0.30)$R_2$ where $R_2$ is the radius of the roller 2.

In a concrete embodiment, the radiuses $R_1$ and $R_2$ preferably have the following values: $R_1$=6.5 mm; $R_2$=7.5 mm.

Preferably, the rolling surfaces 26 and 28 should moreover have a mean surface roughness $R_z$=8 to 16 $\mu$m.

Tests carried out by the present applicant have proved that the conformation of the positioning notches as described above enables a reduction in the noise level of the device to 36–40 dB.

What is claimed is:

1. A door-stop device for vehicles, comprising:

a base structure carrying a pair of rollers that turn about respective axes which are parallel to one another and are elastically pushed against one another; and a metal tie rod having a pair of rolling surfaces set opposite to one another, on which the above-mentioned rollers act, said rolling surfaces presenting at least one positioning notch designed to be engaged by one of said rollers to define a position of stable retention of the door, wherein said positioning notch presents:

an arched central portion having a radius of curvature $R_a$=(10 to 15)$R_1$, where $R_1$ is the radius of the corresponding roller;

a pair of arched lateral portions with a radius of curvature $R_b$=(1.1 to 1.8)$R_1$, and wherein the aforesaid central portion has a dimension, in the direction of the longitudinal axis of the tie rod, A=(0.15 to 0.30)$R_1$.

2. A door-stop device according to claim 1, wherein the aforesaid positioning notch (32) has a depth $h_1$=(0.12 to 0.50)$R_1$.

3. A door-stop device according to claim 1, comprising at least one second positioning notch set in a position opposite to that of the aforesaid positioning notch, the second positioning notch having an arched shape with a radius of curvature $R_d$=(1.1 to 1.6)$R_2$, where $R_2$ is the radius of the corresponding roller (2).

4. A door-stop device according to claim 3, wherein the aforesaid second positioning notch has a depth $h_2$=(0.12 to 0.30)$R_2$.

5. A door-stop device for vehicles, comprising:

a base structure carrying a pair of rollers that turn about respective axes which are parallel to one another and are elastically pushed against one another; and a metal tie rod having a pair of rolling surfaces set opposite to one another, on which the above-mentioned rollers act, said rolling surfaces presenting at least one positioning notch designed to be engaged by one of said rollers to define a position of stable retention of the door, and wherein said rolling surface present a means surface roughness $R_z$=8 to 16 $\mu$m;

wherein said positioning notch presents;

an arched central portion having a radius of curvature $R_a$=(10 to 15)$R_1$, where $R_1$ is the radius of the corresponding roller;

a pair of arched lateral portions with a radius of curvature $R_{b=(}$1.1 to 1.8)$R_1$; and wherein the aforesaid central portion has a dimension, in the direction of the longitudinal axis of the tie rod, A=(0.15 to 0.30)$R_1$.

* * * * *